US007980836B2

(12) United States Patent
Shaw

(10) Patent No.: US 7,980,836 B2
(45) Date of Patent: Jul. 19, 2011

(54) MODULAR MULTI-ROTOR COMPRESSOR AND METHOD OF MANUFACTURE

(76) Inventor: David N. Shaw, East Falmouth, MA (US)

( * ) Notice: Subject to any disclaimer, the term of this patent is extended or adjusted under 35 U.S.C. 154(b) by 356 days.

(21) Appl. No.: 12/134,389

(22) Filed: Jun. 6, 2008

(65) Prior Publication Data

US 2009/0304538 A1 Dec. 10, 2009

(51) Int. Cl.
*F04C 18/00* (2006.01)
*F04C 2/00* (2006.01)

(52) U.S. Cl. ..... 418/197; 418/190; 418/201.3

(58) Field of Classification Search ..... 418/189, 418/190, 196, 197, 201.1, 201.3
See application file for complete search history.

(56) References Cited

U.S. PATENT DOCUMENTS

| | | | | |
|---|---|---|---|---|
| 2,079,083 | A * | 5/1937 | Montelius | 418/197 |
| 2,652,192 | A * | 9/1953 | Chilton | 418/197 |
| 3,965,697 | A * | 6/1976 | Beierwaltes | 418/196 |
| 4,145,168 | A * | 3/1979 | Smith et al. | 418/196 |
| 6,003,324 | A | 12/1999 | Shaw | |
| 6,217,304 | B1 | 6/2008 | Shaw | |

* cited by examiner

*Primary Examiner* — Theresa Trieu
(74) *Attorney, Agent, or Firm* — David Fishman

(57) ABSTRACT

A multi-rotor compressor and method of manufacturing is provided. The compressor includes a housing with a plurality of identical planet rotors. The planet rotors are equally spaced apart at a fixed distance from a centerline. A single sun rotor is provided that is disposed to cooperate with the plurality of identical planet rotors in the compression of gas. The number and radial spacing of the plurality of identical planet rotors about said single sun rotor may be arranged in different configurations to change an output capacity parameter for said compressor.

10 Claims, 7 Drawing Sheets

MODULAR MULTI-ROTOR COMPRESSOR AND METHOD OF MANUFACTURE

BACKGROUND OF THE INVENTION

The subject matter disclosed herein relates to a multi-rotor helical compressor. In particular, the subject matter disclosed herein relates to a multi-rotor compressor that is configurable to receive interchangeable planet rotors to provide manufacturing flexibility in assembling compressors having different capacities.

Screw type compressors are a type of compressor used for the compression of gases such as air or refrigerant. In general, the screw compressor rotates one or more rotors having a helical shape within a cavity. As the gas enters the inlet of the cavity, the gas is drawn by the rotating helical shape and compressed by the reduction in the cavity volume. The compressed gas is then discharged through the outlet of the compressor.

One type of compressor, typically referred to as a twin-screw compressor comprises a pair parallel interacting rotors. The rotors are connected by a gear arrangement coupled to a driving motor. The rotors are comprised of helical lobes affixed to a front and rear shaft. One rotor is called the male rotor and the other rotor is the female rotor. The male rotor has bulbous lobes that interact with valleys formed in the female rotor. The valleys are sized to match the curvature of the male lobes. In a typical twin screw compressor, the female rotor will have five valleys and the male rotor has three lobes. With this combination, the male rotor turns 1.66 times to every one time of the female rotor. It should be appreciated that the number of lobes on the male and female rotor will vary from one compressor manufacturer to another. However, the female rotor will typically have numerically more valleys than the male rotor has lobes.

Another type of multi-rotor compressor utilizes a center or "sun" rotor that interacts with two or more parallel "planet" rotors. As with the twin screw compressor, the multi-rotor compressor has both male and female rotors. Systems have been proposed with the sun rotor being either the male or the female rotor. Where the sun rotor is the male rotor, the corresponding planet rotors have a female profile and vise versa. During operation, the compressor motor only drives the sun rotor. The planet rotors are driven by the rotation of the sun rotor through the working fluid or gas being compressed.

Both the sun rotor and the planet rotors are enclosed within a housing. The housing typically includes bores that are formed in a casing to receive the shafts for the sun rotor and planet rotor. The bores provide an axis of rotation for the rotors. While this arrangement works suitably, each compressor size, in terms of output, requires a new design with a different configuration or rotors, rotor lobes, rotor valleys and the like.

While existing multi-rotor compressors are suitable for their intended purposes, there still remains a need for improvements particularly regarding the scalability of the compressor while improving manufacturability of the multi-rotor compressors to minimize manufacturing and assembly costs.

SUMMARY OF THE INVENTION

A compressor is provided having a housing and a plurality of identical planet rotors. Each of the planet rotors has a generally cylindrical shape with an axis of rotation extending there through. The plurality of planet rotors is equally spaced at a fixed distance from a centerline. A single sun rotor having an axis of rotation coaxial with the centerline is disposed to cooperate with the plurality of planet rotors in the compression of gas. The compressor is arranged such that the number and radial spacing of the plurality of planet rotors about the single sun rotor may be arranged in different configurations to change an output capacity parameter for the compressor.

In another embodiment, a compressor having a housing is provided having a compression section with a centerline extending therethrough. A plurality identical planet rotors is arranged to rotate within the housing, the plurality of identical planet rotors are spaced an equal radial distance apart at a fixed distance from the centerline. A single sun rotor is coupled to rotate about the centerline, wherein the single sun rotor and the plurality of identical planet rotors are disposed to cooperate in the compression of gas. The compressor is arranged such that the number of the plurality of single identical planet rotors assembled within the housing may be reduced or increased to change an output capacity parameter.

A method of manufacturing a multi-rotor compressor is also providing including the step of manufacturing a plurality of compressor housings. A plurality sun rotors and a plurality of identical planet rotors are manufactured. A first compressor is assembled with one of the plurality of compressor housings and one of the sun rotors. A first order is received for a second compressor having a first output. A first desired number of planet rotors is selected to achieve said first output. Then the first selected planet rotors are assembled into said first compressor.

BRIEF DESCRIPTION OF THE DRAWINGS

Referring now to the drawings, which are meant to be exemplary and not limiting, and wherein like elements are numbered alike.

DETAILED DESCRIPTION

Figure 1:
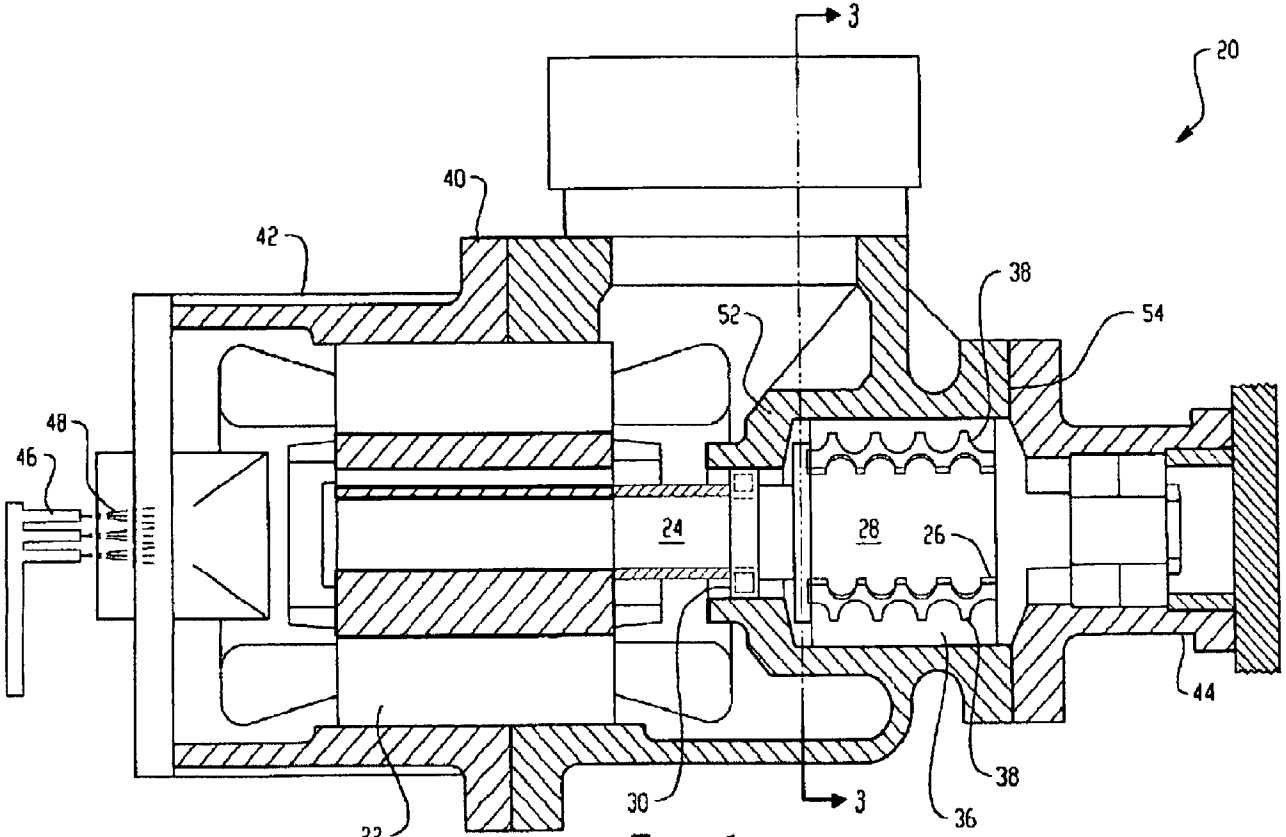
FIG. 1 is a schematic side cross sectional illustration of a compressor having a multi-rotor configuration in accordance with an exemplary embodiment.

FIG. 1 illustrates an exemplary embodiment multi-rotor compressor 20. The compressor 20 compresses gases by using a sun rotor 26 that is paired with two or more planet rotors 38. A hermetically sealed motor 22 having a shaft 24 is coupled to a rotor shaft 28 of sun rotor 26. The motor 22 may be any suitable type of motor, such as but not limited to a brushless dc motor or an induction motor for example. A bearing 30 is mounted at one end of the rotor shaft 26 and supports the shaft 24 in any radial bearing loads. The bearing 30 may be a cylindrical roller bearing, a double-row ball bearing, a single-row ball bearing, or a tapered roller bearing for example. The sun rotor 26 and two or more planet rotors 38 are arranged within the compression portion 36 of a housing 40.

The housing 40 contains and supports the motor 22 and the rotors 26, 38. The housing 40 may be comprised of one or more casings to form the induction end 42 and the discharge end 44. The induction end 44 receives a gaseous fluid, such as a refrigerant for example, with entrained droplets of liquid fluid. In a refrigeration application, the gaseous refrigerant may be received from an evaporator for example. Alternatively, the droplets of fluid 48 may introduced into the fluid stream by atomization of the liquid droplets by an atomizer 46 for example.

The compression portion 36 of housing 40 includes a first end 52 adjacent to the motor 22 and a second end 54 adjacent the discharge end 44. The housing 40 are fabricated from a suitable material, such as steel or aluminum and may be manufactured from a casting or a forging with secondary machining operations for example.

Figure 2:
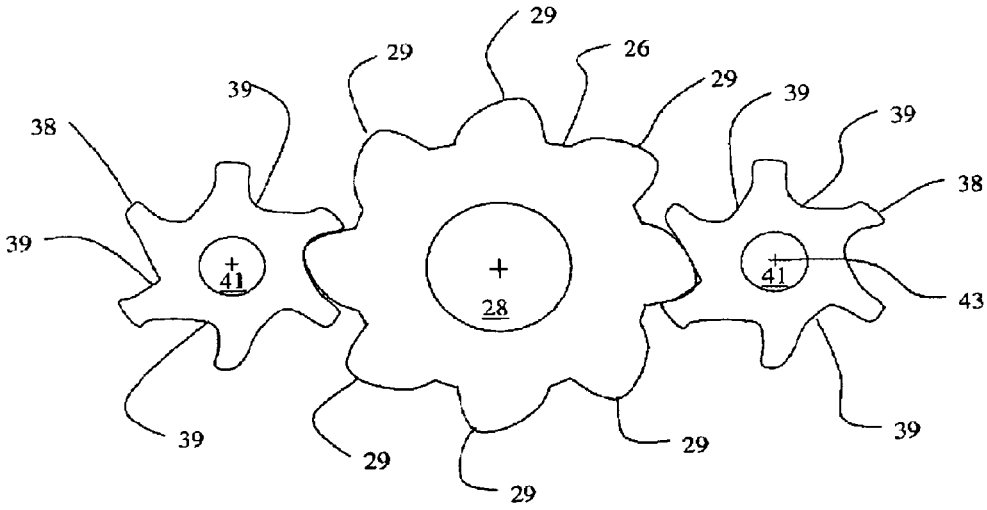
FIG. 2 is a schematic cross sectional illustration of a sun-planet rotor configuration for the compressor of FIG. 1.
Figure 3:
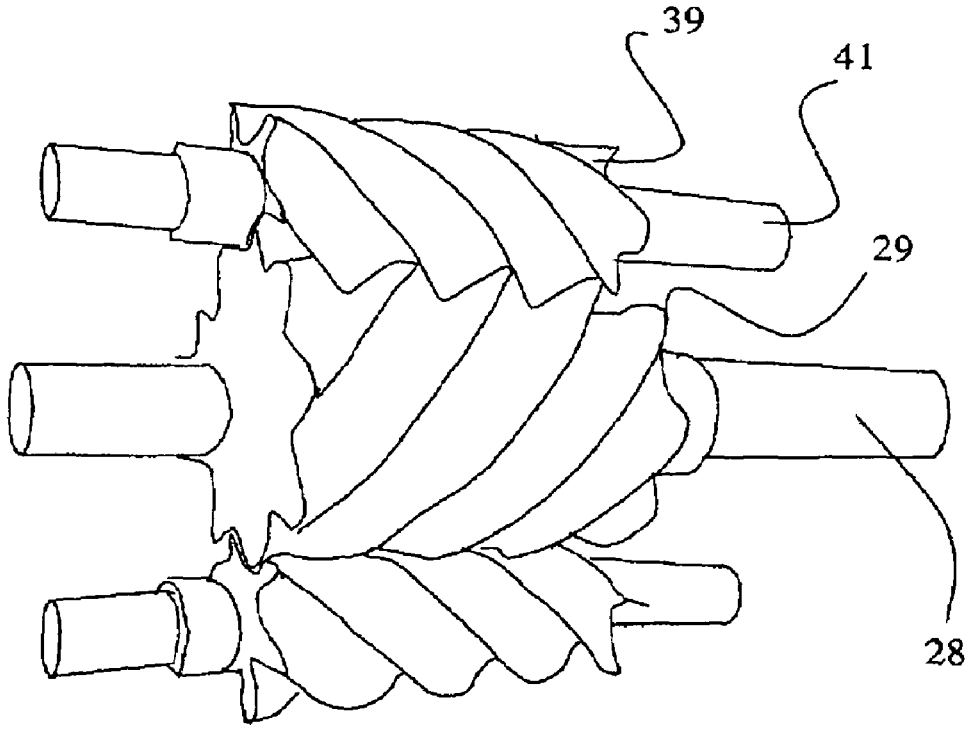
FIG. 3 is a perspective view illustration of the sun-planet rotor configuration of FIG. 2.

In a multi-rotor compressor, the compression of the fluid is due to the interaction of the center or sun rotor 26 with two or more planet rotors 38 as shown in FIG. 2 and FIG. 3. The sun rotor 26 includes the shaft 24 that is coupled to the motor 22 as discussed above. In the embodiment illustrated in FIG. 2, the sun rotor 26 is the "male" rotor and includes a plurality of helical lobes 29. In the exemplary embodiment, the lobes 29 are integrally formed on the sun rotor 26 and are formed from a suitable material for use in compressors. The lobes 29 are sized and shaped to interact with the helical flutes 39 on the planet rotors 38. The planet rotors 38 rotate on a shaft 41 which arranged parallel to the shaft 24. During operation, the rotors 26, 38 rotate under the force of motor 22 causing the gas to travel along the gap between the lobes 29 and the flutes 39. This action gradually increases the pressure of the gas as it is forced from the first end 52 to the discharge end 44.

The compressor 20 may be configured for different compression output capacities by configuring the number and placement of identically configured planet rotors 38 while utilizing a common housing 40, motor 22 and sun rotor 26. In the exemplary embodiment, the design of the sun rotor 26 and planet rotors 38 remains the same across a range of compressors having different output capacities. This arrangement provides advantages in reducing the cost of manufacturing including material costs through the use of common parts and the ability for late stage identification of the compressor model during the assembly process.

Figure 4:
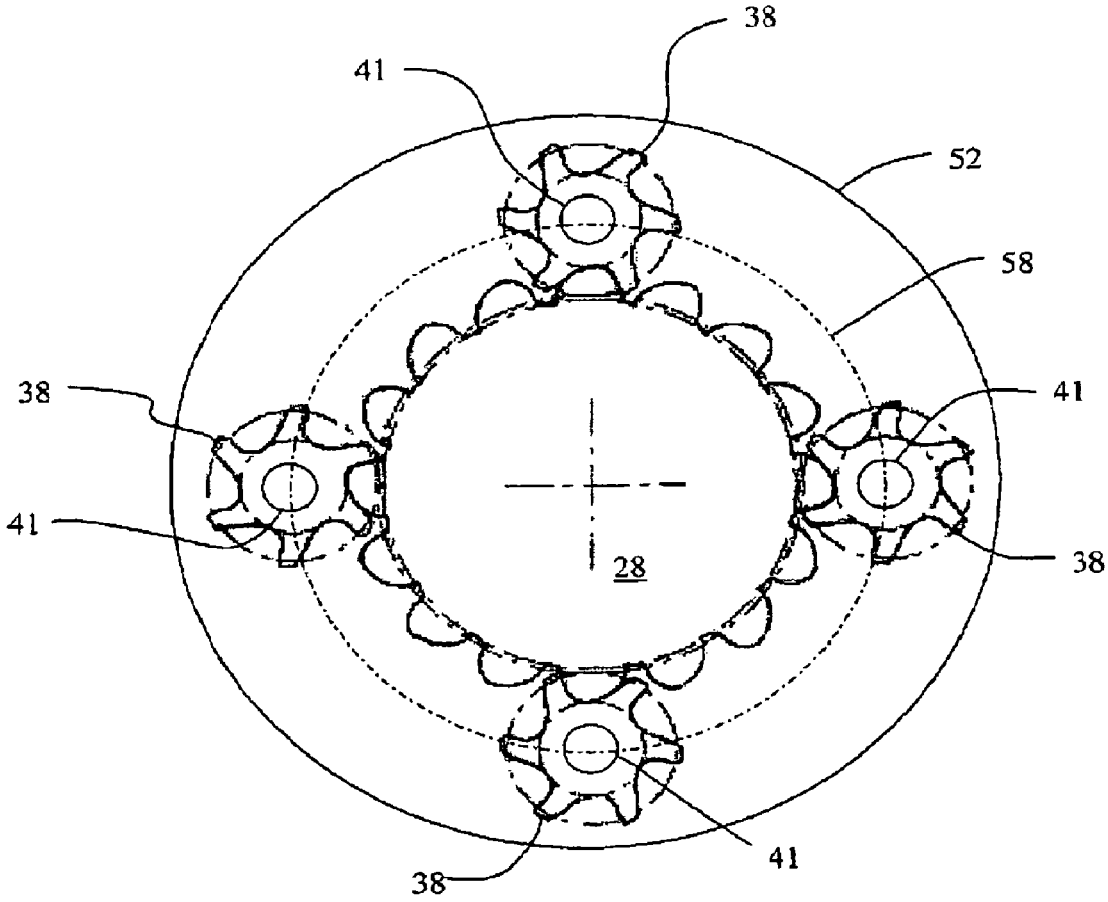
FIG. 4 is a partial front plan view illustration taken along line 3-3 for a compressor having four planet rotors.
Figure 5:
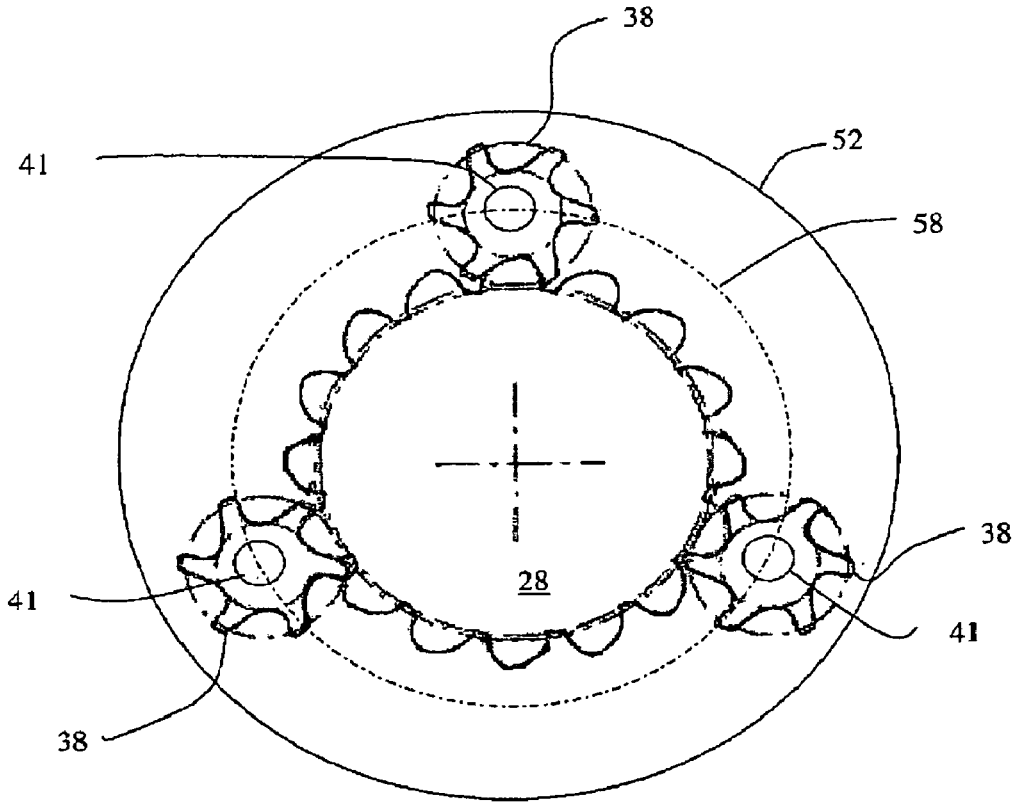
FIG. 5 is a partial front plan view illustration taken along line 3-3 of FIG. 1 for a compressor having three planet rotors.
Figure 6:
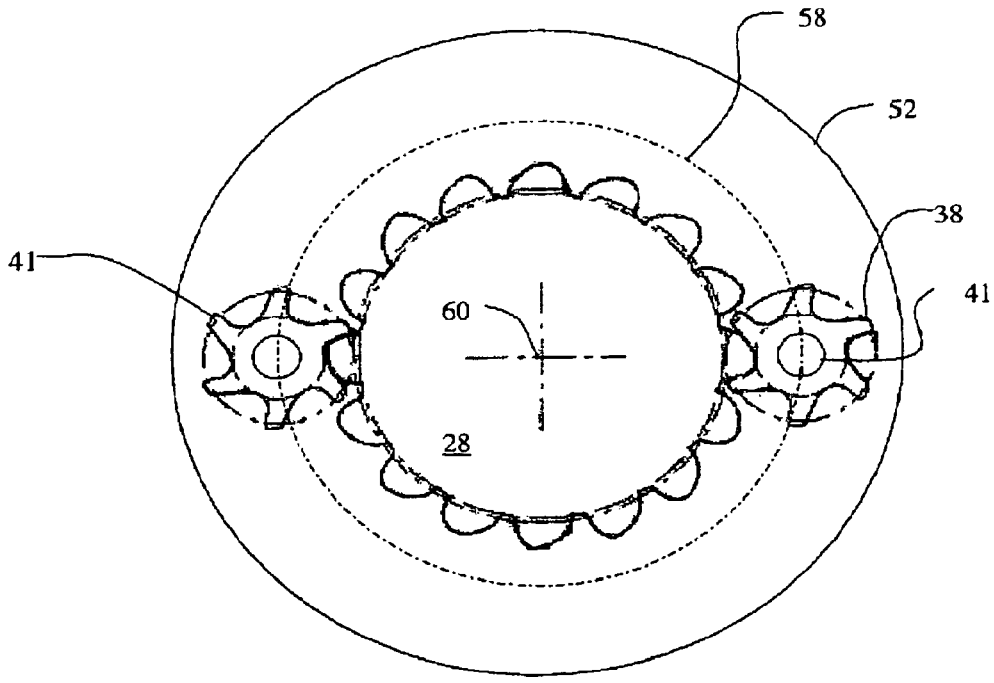
FIG. 6 is a partial front plan view illustration taken along line 3-3 of FIG. 1 for a compressor having two planet rotors.

Referring now to FIGS. 4-6, the configurability of the planet rotors 38 will be described. It should be appreciated that the more planet rotors arranged about the sun rotor 26, the greater the output of the compressor 20. In general, the number of rotors may not be scaled upwardly, meaning that the planet rotor design for a two-planet rotor compressor cannot be scaled up to a three-planet rotor design. However, the inverse is true, the number of planet rotors may be scaled downward, meaning that a four planet-rotor compressor design may be used with three planet-rotors or two planet rotors. This constraint is due to the relationship of lobes and flutes on the sun-rotor and planet rotors. This combination needs to be arranged allow the planet rotors to be spaced equally about the sun rotor.

When the number of rotors is decreased, say from four planet rotors 38 as shown in FIG. 4 to three planet rotors 38 shown in FIG. 5, the output capacity of the compressor 20 decreases by 25%. As the number of rotors decreased from three planet rotors 38 to two planet rotors shown in FIG. 6, the output capacity of the compressor 20 decreases to one-half of the four-planet rotor arrangement.

It should be appreciated that there are many different commercially viable combinations of the sun rotor 26 and the number of planet rotors 38, the number of lobes 29 and the number flutes 39 depending on the performance characteristics desired by the markets and applications being addressed. For exemplary purposes, an example compressor 20 will be described. The compressor 20 includes a sun rotor 26 having 16 lobes disposed thereon. The sun rotor 26 has an outside diameter of 185 mm and a length of 108 mm. The planet rotor 38 includes 6 flutes/valleys sizes to match the lobes of the sun rotor 26. The planet rotor 38 has an outside diameter of 72 mm and a length/diameter ratio of 1.5. The motor 22 of compressor 20 rotates the sun rotor 26 at a sufficient speed to rotate the planet rotors at 9,333 revolutions per minute.

When this compressor 20 is configured with 2 planet rotors 38, such as that illustrated in FIG. 6, the output capacity of the compressor 20 is 168 cubic feet per minute. If this compressor 20 is configured instead with three of the planet rotors 38, the output capacity is increased to 252 cubic feet per minute. Similarly, if four planet rotors 38 are configured in the compressor 20, the output capacity is increased to 336 cubic feet per minute. Thus, the capacity of the compressor 20 is doubled while using the same housing 40, motor 22, and only one sun rotor 28 and planet rotor 38 design.

Figure 7:
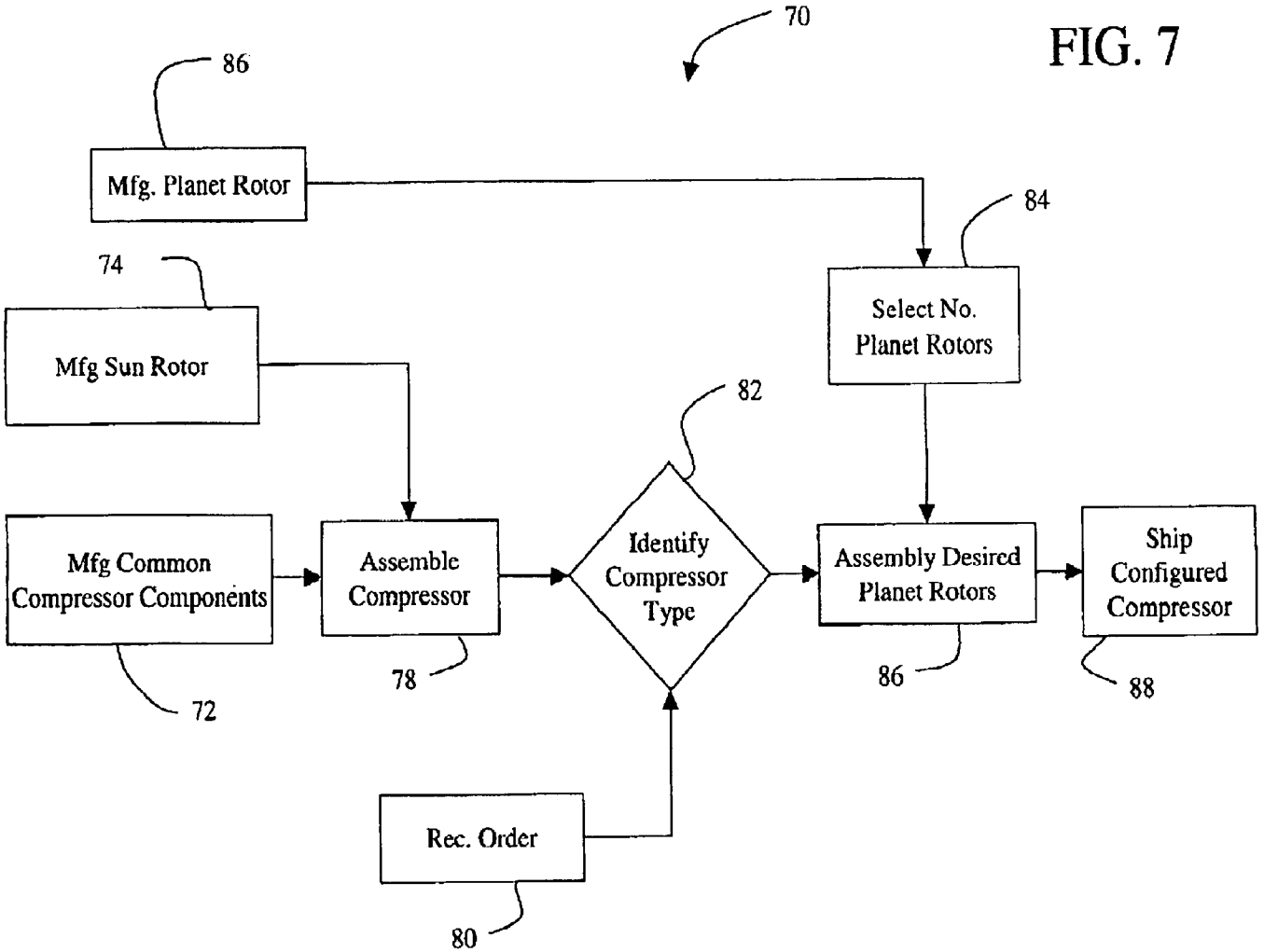
FIG. 7 is a schematic flow chart illustrating a method of manufacturing the compressor of FIG. 1.

The ability to configure the same compressor 20 to operate at a wide variety of output capacities with the same components or with only minor part substitutions provides advantages in reducing manufacturing costs and a assembly costs. Since only one planet rotor 38 design is used, the manufacture can increase the quantities manufactured and thus gain advantages in scales of economy. An exemplary manufacturing process 70 is illustrated in FIG. 7.

The process 70 starts in box 72 with the manufacture of common compressor components such as the housing 40, motor 22, and shaft 24. It should be appreciated that a single motor 22 design may be used for all configurations of compressors as a common component. Alternatively, motors may be sized for each individual compressor configuration. For example, in the alternative embodiment the motors may be configured with different stack lengths to minimize costs. In parallel with the manufacture of the common components, a plurality planet rotors 38 is manufactured in box 86 and a plurality of sun rotors 26 are manufactured in box 74. The common components from box 72 and the sun rotors from box 74 are assembled into sub-assemblies in box 78.

When the manufacturer in box 80 receives an order, the manufacture can identify in box 82 the type and compression output capacity needed to fulfill the order. For example, the application may require 252 cubic feet per minute. The appropriate number of planet rotors 38 is then selected in box 84 to achieve the desired compression output capacity, three planet rotors 38 for example. Once the number of planet rotors 38 is selected, the planet rotors 38 are assembled into the compressor 20 in box 86. Once assembled, the compressor may be shipped to the customer in box 88. It should be appreciated that the process 70 enabled by the configurable multi-rotor compressor 20 provides a number of advantages in reducing costs and improving the assembly processes. Since most of the compressor 20 can be assembled prior to receiving the order from a customer, late point identification of the compressor type or model can thus be achieved.

It should be appreciated that the multi-rotor compressor and method for manufacturing the multi-rotor compressor described herein provides advantages to the design, assembly, manufacturability and inventory requirements of the compressor. The compressor and method allows the use of a single sun rotor and single planet rotor design for a variety of compressor capacities. The compressor and method also provides advantages in reducing the inventory requirements and manufacturing costs by minimizing the number different components need to be manufactured. The compressor and method further provide in allowing late point identification of the compressor capacity type providing flexibility in the manufacturing process.

Further, the diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compressor comprising:

a housing;

a plurality of identical planet rotors, each comprising a generally cylindrical shape with an axis of rotation extending therethrough, each of said plurality of identical planet rotors being equally spaced at a fixed distance from a centerline, and each of said plurality of identical planetary rotors having a helical profile on said cylindrical shape;

a single sun rotor having an axis of rotation coaxial with said centerline, said single sun rotor including a helical profile, and said sun rotor helical profile being disposed to cooperate with said helical profiles on said plurality of identical planet rotors in the compression of gas; and, said sun rotor helical profile and said plurality of identical planet rotor helical profiles being sized and arranged to produce a first output when said plurality of identical planet rotors has four planet rotors, a second output when said plurality of identical planet rotors has three planet rotors, and a third output when said plurality of identical planet rotors has two planet rotors, said third output being one-half of said first output.

2. The compressor of claim 1 wherein said plurality of identical planet rotors include two identical planet rotors arranged 180 degrees apart.

3. The compressor of claim 1 wherein said plurality of identical planet rotors include three identical planet rotors arranged 120 degrees apart.

4. The compressor of claim 1 wherein said plurality of identical planet rotors includes identical four planet rotors arranged 90 degrees apart.

5. A compressor comprising:

a housing, said housing having a compression section with a centerline extending therethrough;

a plurality identical planet rotors arranged to rotate within said housing, said plurality of identical planet rotors being spaced an equal radial distance apart at a fixed distance from said centerline, each of said plurality of identical planet rotors having six helical flutes formed thereon;

a single sun rotor coupled to rotate about said centerline, said single sun rotor having sixteen helical lobes formed thereon, wherein said plurality of helical flutes on said planet rotors and said plurality of helical lobes on said sun rotor are disposed to cooperate in the compression of gas; and an output capacity parameter of the compressor being a function of the number of identical planet rotors within said housing.

6. The compressor of claim 5 wherein said plurality of identical planet rotors is two identical planet rotors.

7. The compressor of claim 5 wherein said plurality of planet rotors (has) is three identical planet rotors.

8. The compressor of claim 5 wherein said plurality of planet rotors (has) is four identical planet rotors.

9. The compressor of claim 5 wherein said helical lobes on said planet rotors and said helical flutes on said sun rotor are sized and arranged to produce a first output when said plurality of identical planet rotors has four planet rotors, a second output when said plurality of identical planet rotors has three planet rotors, and a third output when said plurality of identical planet rotors has two planet rotors.

10. The compressor of claim 9 wherein said third output is one-half of said first output.

* * * * *